United States Patent [19]

Boatman

[11] 3,943,571

[45] Mar. 16, 1976

[54] PROTECTIVE HELMET

[76] Inventor: Marvin C. Boatman, P.O. Box 1105, Patterson, La. 70392

[22] Filed: Feb. 7, 1975

[21] Appl. No.: 547,971

Related U.S. Application Data

[63] Continuation-in-part of Ser. No. 409,296, Oct. 24, 1973, abandoned.

[52] U.S. Cl. ..... 2/2.1 R; 2/6; 128/142.7; 292/49

[51] Int. Cl.[2] ..... A62B 17/04; B63C 11/12

[58] Field of Search ..... 2/2.1 R, 2.1 A, 6; 128/142.7

[56] References Cited

UNITED STATES PATENTS

| | | | |
|---|---|---|---|
| 2,569,451 | 10/1951 | Browne | 2/82 |
| 3,172,126 | 3/1965 | Spano et al. | 2/2.1 R |
| 3,221,339 | 12/1965 | Correale, Jr. | 2/2.1 R |
| 3,310,811 | 3/1967 | Iacono, Jr. | 2/2.1 R |
| 3,413,972 | 12/1968 | Depping | 2/2.1 R |
| 3,505,677 | 4/1970 | Masson et al. | 2/2.1 R |
| 3,534,408 | 10/1970 | Fifield | 2/2.1 R |
| 3,680,556 | 8/1972 | Morgan | 128/142.2 |

*Primary Examiner*—Andrew V. Kundrat
*Assistant Examiner*—Conrad L. Berman
*Attorney, Agent, or Firm*—Pugh & Keaty

[57] ABSTRACT

A diving helmet including a uniquely designed three element structure and associated connecting and releasing means for quick bail-out, when, for example, the helmet's umbilical cord is damaged, tangled, or cut, to permit quick release and removal of the outer hard hat helmet. The system includes an inner dry hood with a facial opening framed with an oval, tongue-in-groove type seal along with a separate rigid protective outer helmet made up of a hat portion or hard casque and a mask portion with goggles, the two helmet portions being hingedly connected together (note FIG. 2). The hood seal is adapted to match and mate with the goggle mask assembly (note FIG. 3) sustaining the umbilical lines, gas regulators, window etc. to form a dry enclosure therebetween. Sealing pressure between the base of the hard casque and the cushion of oval elastomer of the hood fitting inside the mask and goggle assembly is developed by a set of quick latches, one on each side of the hard casque which engages the mask and goggle assembly on the facial mask portion. The quick latch has an eccentric latching groove which simultaneously fits the water tight tongue and groove seal causing the seal between the hood and the mask and goggle assembly. The quick latch has an eccentric knob for quick release of the mask and goggle assembly and the hard casque from sealing engagement with the inner hood, the outer helmet then being easily removed from around the head of the diver by moving the casque about the hinge connection and away from the head (note FIG. 5).

13 Claims, 8 Drawing Figures

PROTECTIVE HELMET

REFERENCE TO RELATED APPLICATION

This application is a continuation-in-part of the prior copending application Ser. No. 409,296, filed Oct. 24, 1973 and entitled "Divers Helmet," now abandoned in favor of this application.

BACKGROUND OF THE INVENTION

1. Field of the Invention

The present invention relates to a protective helmet structure allowing for quickly release and bail-out of the helmet, when, for example, the umbilical cord is damaged, tangled, or cut. The present invention has been found to be particularly useful in the deep diving, hard helmet art, and hence will be discussed with particular reference thereto. However, the present invention is applicable to other types of helmet devices requiring sealing and umbilical cord attachments as well.

2. Description of the Prior Art

When an umbilical line is damaged, tangled or cut, there is a necessity for the diver whose mask is being supplied by the umbilical cord to release the mask. Without releasing the mask, the diver is at the mercy of the surface tenders and his gear. To reduce the likelihood of death or great injury to the diver, a releasable helmet structure with latches and positive seals have been developed in the present invention.

Several types of releasable diving helmets have been known and used before, and typical examples thereof in the hard helmet, diving art are shown in U.S. Pat. No. 3,534,408, issued Oct. 20, 1970, to T. B. Fifield; U.S. Pat. No. 3,505,677, issued Apr. 14, 1970 to Y. LeMasson, et al.; and U.S. Pat. No. 3,680,556, issued Aug. 1, 1972 to B. B. Morgan. Examples of helmets having a seal between an inner hood and an outer helmet at facial portions thereof are shown in the LeMasson patent supra and U.S. Pat. No. 3,310,811, issued Mar. 28, 1967 to V. D. Iacono. Jr.; U.S. Pat. No. 3,740,764, issued June 26, 1973, to I. B. Elstrom, et al.; U.S. Pat. No. 3,413,972, issued Dec. 3, 1968, to C. L. Depping; and U.S. Pat. No. 2,569,451, issued Oct. 2, 1951 to J. Browne.

The Iacono device relates to a gas mask type of enclosure rather than a hard hat device.

The Elfstrom et al., Depping, and Browne devices, although being diving devices, also relate to soft helmet structure devices.

The Fifiend device is a heavy rigid shell device sealing at the neck which defines a relatively large sealed area creating buoyancy problems.

The LeMasson et al. device is also a hard helmeted device of a light construction but otherwise would be difficult in a bail-out situation, requiring that the helmet be flipped up against a vacuum, it would be additionally difficult to pull up the helmet because of the construction of the neck piece.

The Morgan device also fails to disclose an efficient method for umbilical cord failure release, requiring quick reaction in order to avoid facial squeeze because of the sealing arrangement.

SUMMARY OF THE INVENTION

The present invention uses a very simple but highly effective design including an inner dry flexible hood preferably of elastic material covering all of the diver's head and neck in relatively close proximity thereto except for the facial portion thereof and a separate rigid outer helmet, the hood and the outer helmet having sealing means about the facial area, to maintain a positive seal between the hood and the helmet until the diver is prepared to release the helmet from the hood. Latching means are provided for quickly releasing the helmet and accompanying umbilical cord from the diver's hood. The present invention, while utilizing seal means and a diver's helmet uses them in relationship to the diver's hood and fastening means to maintain a seal from the environmental water even without the presence of regulated gas preventing inrush of water to permit the diver time to activate his back-up, life preserving system and then at the proper time to release his dependency upon the helmet and the umbilical cord.

In the preferred embodiment the helmet includes a top hat or casque portion and a front masked goggle portion which are top hinged together, to permit easy pulling away of the other helmet after the helmet and hood seal has been released. Additionally the preferred embodiment increases a superior main sealing structure between the inner hood and the outer protective helmet and a most efficacious latching mechanism.

BRIEF DESCRIPTION OF THE DRAWINGS

For further understanding of the nature and objects of the present invention, reference should be had to the following detailed description, taken in conjunction with the accompanying drawings, in which like parts are given like reference numberals and wherein.

DETAILED DESCRIPTION OF THE PREFERRED EMBODIMENT

Introduction

The diving helmet of the preferred embodiment of the present invention may be used to supply regulated air and gas to any diver wherein it is important that the helmet sealing be maintained in a reliable manner to prevent water leakage even where inadequate sealing gas pressure is present and to permit quick disconnection of the helmet with its umbilical cord in case of an emergency. A particularly important area of application of the present invention is in deep diving, hard helmet construction using umbilical cords wherein positive seals must be kept at all times on the face of the diver with the ability to quickly release the hard helmet. However, it should be realized that the present invention could be applied to, for example, any application where it is desired to seal the user from the outside emvironment and also permit him quick release from the helmet by his own action. For example, the protective helmet of the present invention with appropriate and obvious modifications could be used as a space helmet, an airman's helmet, or a combined soldier's gas mask-and-helmet, etc., that is in applications where it is important to isolate the user from the exterior fluid ambient, whether the ambient be liquid or gaseous.

In the preferred embodiment of the present invention, the sealing of the helmet with the hood is accomplished through inserting a gasket into an orifice within the helmet structure, the gasket being cemented to the hood. A pressure sealing and lock is then accomplished through a latching structure which also permits quick release of the outer helmet through a top hinge when the diver at his discretion feels an emergency has arisen requiring release from the helmet.

Structure and Its Method of Use

As shown generally in FIGS. 1, 2, 5 & 8, the preferred embodiment of the diving helmet 10 of the present invention comprises three basic elements, an inner flexible hood 1, and an outer protective hard or rigid helmet 2/3, the latter comprising a top, hat portion or casque 2 and a front, mask and goggle portion 3 hingedly connected together.

Figure 5:
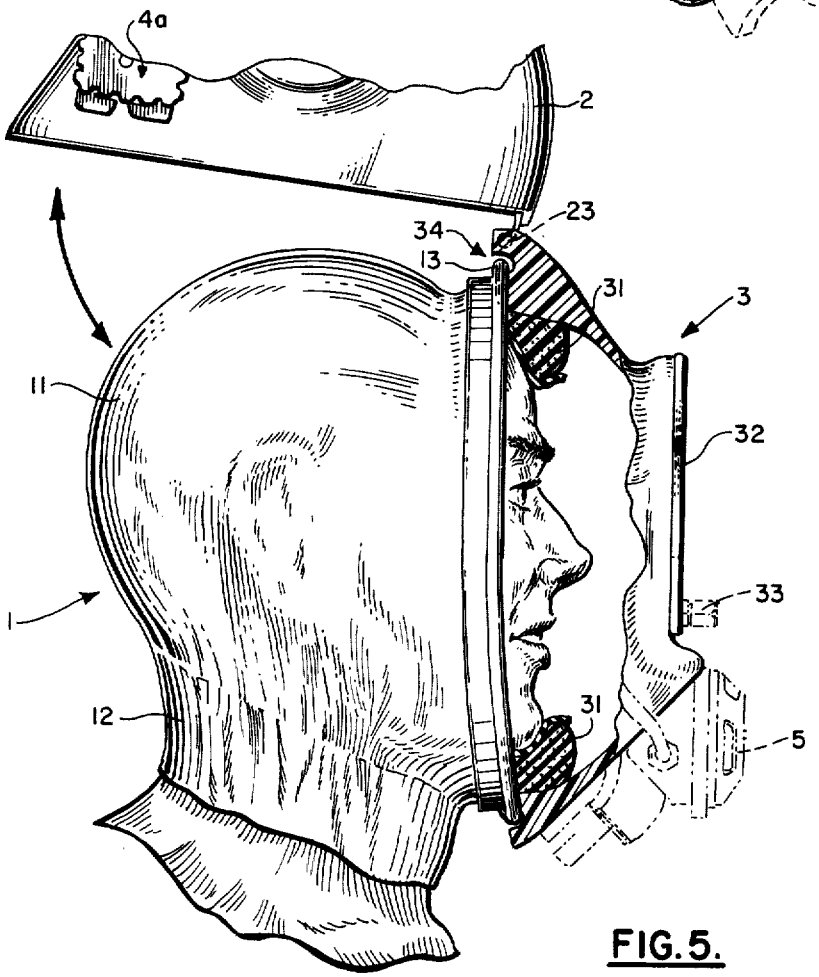
FIG. 5 is a side view of the preferred embodiment of the apparatus of the present invention showing the helmet in its unlocked or open state, with the hat portion partially shown and the mask portion partially cut-away.
Figure 2:
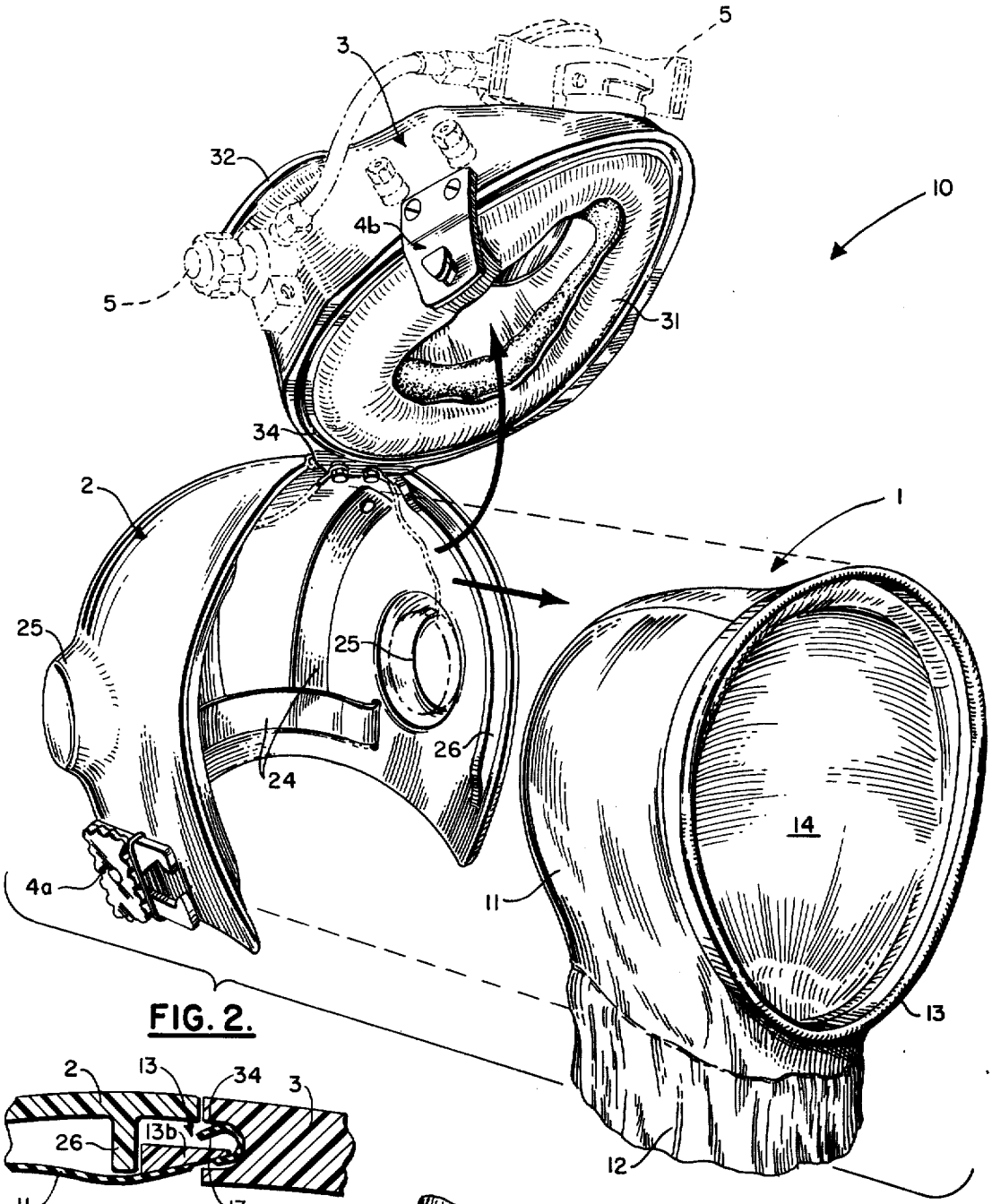
FIG. 2 is an exploded view of the hood element and the helmet elements of the preferred embodiment of the apparatus of the present invention, with the latter being shown in its open state and with the breathing mechanism shown in phantom line.

Referring particularly to FIGS. 2 and 5, there is shown the inner dry hood 1 made of flexible, elastic or elastomer material such as for example, rubber. A facial opening 14 is framed with a plastic or other relatively rigid material to form a tongue seal member 13 around the area which is placed in proximity to the facial portions of the diver. Tongue seal member 13 is suitable for insertion within sealing groove 34 in the mask 3 as explained more fully below. The dry hood 1 terminates at the lower neck portion of the diver in the elastic, constrictive, elastomer throat 12 for forming a water-tight seal around the neck portion of the diver (note FIG. 5).

Figure 1:
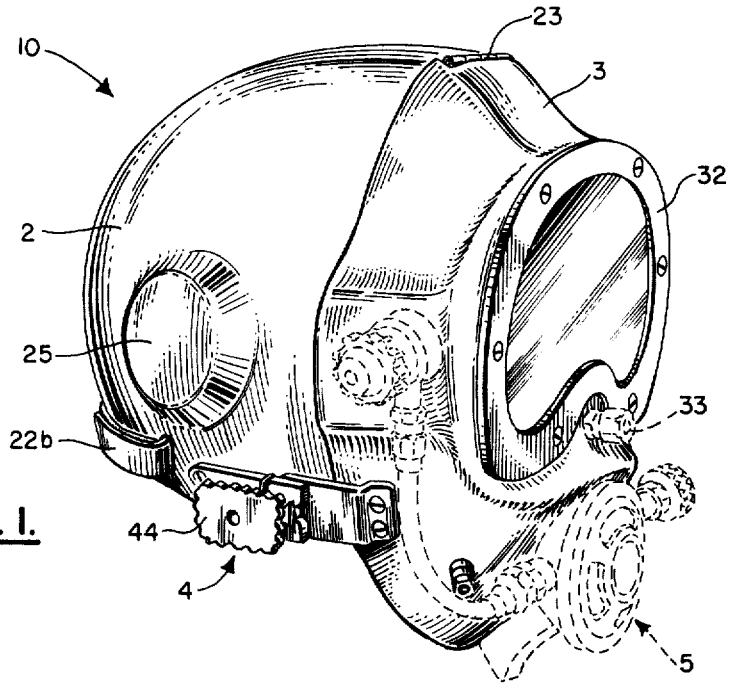
FIG. 1 is an elevated view of the preferred embodiment of the apparatus of the present invention showing the helmet in its closed state with the umbilical cord breathing mechanism shown in phantom line.

As best seen in FIGS. 1, 2, & 5, the hat and mask portions 2 & 3 of the outer protective helmet are hinged together by means of top hinge 23, which is a rigid piano type made of Monel or other non-corrosive type of material, and which allows the two helmet portions 2/3 to move the total of at least 90° with respect to one another. This helmet structure allows the entire outer helmet to be easily removed from around the diver's head by moving the hat portion 2 up about the hinge connection 23 an forward along the mask portion 3 away from the head. The diver thus has the advantage of a hard rigid outer helmet completely surrouding his head for protection, but is still able to quickly and easily remove it, for example, for emergency bail-out purposes.

Figure 4:
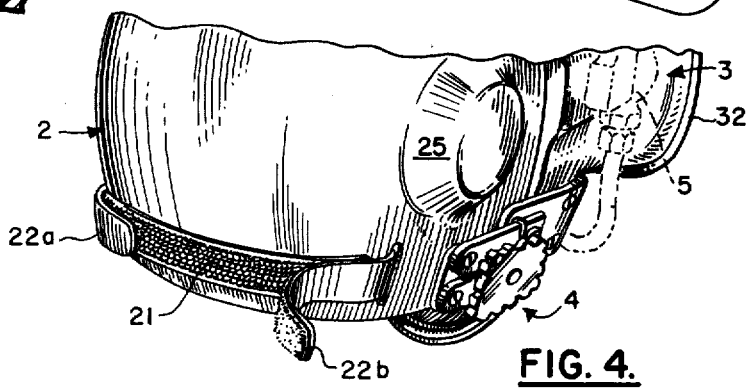
FIG. 4 is a back, elevated, partial view of the preferred embodiment of the apparatus of the present invention.

As can best be seen in FIG. 2, the casque or hat portion 2, which can be made of plastic or fiberglass, includes fitting or support straps 24 on its interior for fitting the standard-sized helmet to the particular head size of the diver. As best seen in FIG. 4, the location of the interior straps 24 and therefore the fit of the helmet is controlled by the exterior straps **22*a* & 22*b* which connect to the ends of the interior straps 24. The other ends of the exterior adjustment straps 22*a* & 22*b* mate with the exterior fixed back strap 21 in any suitable manner, a "VELCRO" type fastening system being shown for illustrative purposes. The hat portion 2 also includes opposed ear portions 25 which can house headphones (as shown in phantom line in FIG. 2). Along the front edge of the face mask opening of the casque 2 is a ledge, ridge or abutment 26 (note FIG. 2) which plays an important role in the sealing engagement between the inner dry hood 1 and the other protective helmet 2/3**, as explained more fully below.

The mask portion 3, as best seen in FIG. 2, includes a sponge rubber ring gasket 31 that further supplements the sealing action between the hood 1 and the helmet 2/3 by engaging, fitting about and being pressed against the diver's face (note FIG. 5). The sponge rubber ring gasket 31 also serves as comfort padding to adapt the face of the diver and position the diver's mouth and nose to breathe life supporting gas within the mask 3 provided by the breathing and regulating mechanism 5 (shown in phantom line) which is connected to the surface by an umbilical cord (not shown) up to the surface or in a scuba configuration to tanks straped to the back of the diver (not shown). At its front the mask 3 includes a glass window or viewing port assembly 32 with standard control 33.

At its rear the mask 3 has a completely encircling sealing groove 34 which cooperates with the tongue or lip 13 of the hood 1 and the ledge or abutment 26 of the hat portion 2 to form the major front seal between the diver's face and the ambient.

Figure 3:
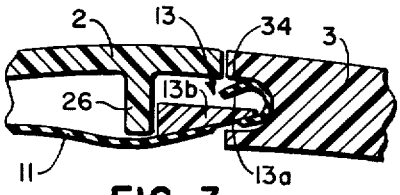
FIG. 3 is a side, partial, cross-sectional view taken along section lines 3—3 of FIG. 8, showing the helmet-to-hood sealing structure.

As shown in close-up detail in FIG. 3, tongue seal 13 includes a triangular-shaped rim **13*b* glued, cemented, or attached by other suitable means to the head portion 11 of the dry hood 1 with a curved sealing piece 13*a* suitable for insertion into the sealing groove 34 of mask and goggle portion 3 of the hard outer helmet. The edge or abutment 26 of the casque 2 pushes against the back of the triangular wedge 13*b* driving and securing the curved lip 13*a* into the curved groove 34, producing a strong, tight and secure seal. As noted above, the dry hood 1 terminates at the lower neck portion of hood 1 in the constricted, sealing throat 12. The combination of the neck seal at throat 12 and the main face seal between the hood 1 and the mask 3 secured by the hat 2 keeps the diver's head fully dry. Moreover, even were there to be some leakage at either the neck or the main face seal, the sponge rubber ring gasket 31 provides additional, supplemental sealing, further ensuring a liquid and vapor tight seal between the diver's face and the interior of the mask 3**.

The present invention procedes from and has grown out of a diver's practical experience, who discovered the folly of not being able to bail-out of defunct life-supporting diving gear. The invention is directed to giving a diver a decent chance to save his own life, when nothing or no one else can.

Figure 6:
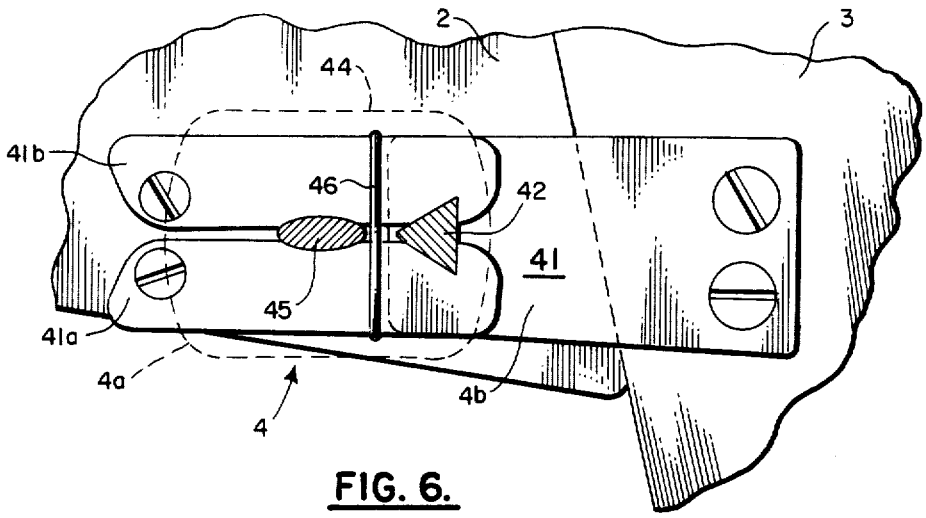
FIG. 6 is a side, partial view of the preferred embodiment of the apparatus of the present invention showing the latch, with the latch mechanism being shown partially in cross-section and partially in phantom lines.
Figure 7:
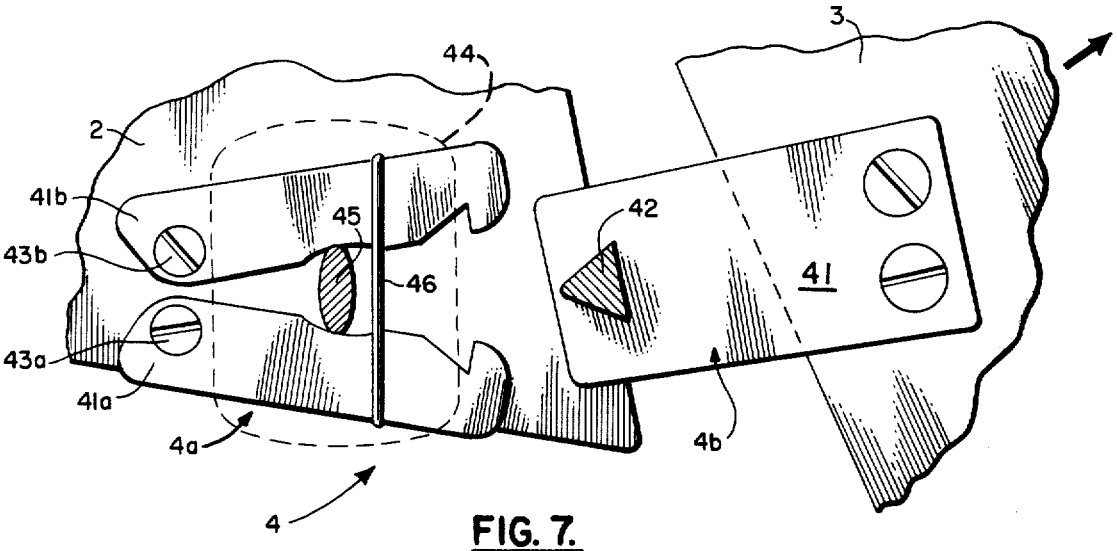
FIG. 7 is a side, partial view of the preferred embodiment of the apparatus of the present invention showing the latch mechanism in an open state, with the latch mechanism being shown partially in cross-section and partially in phantom line.
Figure 8:
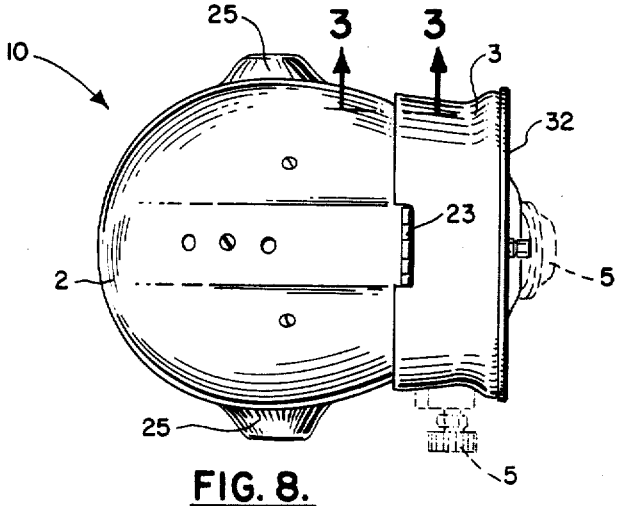
FIG. 8 is a plan elevated view of the preferred embodiment of the apparatus of the present invention showing the helmet in a closed state with the breathing mechanism shown in phantom line.

The latch mechanism 4 is shown in close-up detail in FIG. 6 & 7. Each latch 4 included a hat portion 4*a* and a mating mask portion 4*b*, the latter of which includes a stainless steel plate 41 which is attached to the side of mask 3 by, for example, two screws. Attached to the plate 41 is a pin 42 which is triangular in cross-sectioned shape. Plate 41 and triangular pin 42 are located on each side of mask 3 in such a manner that when hat 2 and mask 3 are pivoted together by means of hinge 23, the pointed end of the triangular pin 42 forces pivotable levers 41*a* and 41*b* outward until it enters into and engages the triangular space formed between the levers 41*a* and 41*b*. An elastic band 46 set in notches in the edges of levers 41*a* and 41*b* and near the operating know 44 forces latch levers 41*a* and 41*b* together and holds them together against the locking pin 42.

Rotatably connected to the hat 2 is elliptical shaft 45 which is biased in the locking position shown in FIG. 6. Splined or keyed to shaft 45 is an elongated control knob 44 with knurling to assist finger gripping. Shaft 45 and knob 44 are positioned such that when the long axis of both knobs 44 and elliptical shaft 45 are perpendicular to the elastic band 46 (note FIG. 6), lever arms 41*a* and 41*b* are positioned to hold pin 42. When the long axis of shaft 45 and knob 44 are parallel with the elastic band 46 (note FIG. 7), lever arms 41*a* and 41*b* are forced apart, stretching band 46 and permitting mask 3 to be withdrawn from contact with hat 2 by permitting pin 42 to be disengaged and withdrawn from engagement with lever arms 41*a* and 41*b*.

When the helmet and hood assembly 10 is first mounted on the diver, hood 1 is first placed over his head with the constricted elastic neck portion 12 forming a water-tight seal around the neck portion of the diver. Then the light, hand-held helmet mask portion 3 is placed over the divers face so that the tongue or lip 13 fits into the sealing groove 34 of the mask 3, and hat portion (note FIG. 5) is pivoted downward to force pin 42 between latching arms 41*a* and 41*b* with the knob 44 axis biased in its position perpendicular to the elastic band 46, thereby engaging pin 42 to secure the hat/mask assembly 2, 3. The latching of latch 4 forces ridge 26 against the base of wedge 13*b* thereby forcing flexible, curved seal 13*a* and the tip of wedge 13*b* into sealing engagement with the curved interior surface of the groove 34. The curved edge of 13*a* is self-sealing against water incursion because of its shape. The latching of the two parts 4*a*, 4*b* of latch 4 also forces rubber seal 31 against the face of the diver and strap 24 against the hood 11 thereby completing the secure sealing of the diver from external water and the covering of the diver's head with a protective shell. The light outer protective helmet is comfortably carried on the head of the diver by means of the webbing of adjustable interior straps 24 and the soft ring gasket 31. Additionally, because the water if free to flow up between the hat portion 2 and the hood 1, no helmet buoyancy problems are encountered.

If it is necessary for the diver to disconnect himself from the helmet mask combination 2 and 3 with its umbilical cord (not shown), the diver can by quarter-turn of his hands in a clock-wise direction rotate control knobs 44 so that the knobs' long axes are parallel to the bands 46, and thus release the latches 4. Then without removing his hands from the latch knobs, the diver can lift the hat portion 2 up and the mask 3 forward in one sweeping movement which is quick and continuous to throw off the entire hat 2 and mask 3 and associated umbilical cord (not shown), and instantly be free swimmming on his own power and, if provided, using oxygen from back-up tanks strapped to his back (also not shown). It is further noted that, because of the top hinge connection between the hat and mask portions 2/3, the seal between the helmet and the hood is broken along only limited portions at any one time as the hat portion 2 is continuously swung up and away.

Although the system described in detail supra has been found to be most satisfactory and preferred, many variations in structure and method are, of course, possible. For example, a simple wedge structure for seal 13 may be used. Also, the long axis of elliptical shaft 45 and knob 44 may be perpendicular to each other. Additionally, knob 42 may be a hemisphere. Moreover, lever arms 41*a* and 41*b* may be mounted on a plate which is mounted on hat 2. Moreover, the materials of construction may be of any suitable choice.

The above, are, of course, merely exemplary of the possible changes or variations.

Because many varying and different embodiments may be made within the scope of the inventive concept herein taught and because many modifications may be made in the embodiment herein detailed in accordance with the descriptive requirements of the law, it should be understood that the details herein are to be interpreted as illustrative and not in a limiting sense.

What is claimed as invention is:

1. A diver's helment comprising:

flexible, elastic, inner hood means for covering all of the diver's head and neck in relatively close proximity thereto except for the facial portions thereof, said hood means having a facial opening around the area which is placed in proximity to the facial portions of the diver and having a hood sealing member around said opening, said hood means having a constricted neck opening for forming a water-tight seal around the neck portion of the diver; and a separate, rigid, protective outer helmet having a transparent face plate mask portion therein and having a helmet sealing member around said face plate mask portion; said outer helmet and said hood being two structurally separate elements which can be temporarily joined together during use as a diving helmet to form a water-tight seal but which can be relatively easily separated for bail-out purposes; said transparent face plate mask portion and said facial opening being aligned together and said helmet sealing member and said hood sealing member being connected together to form a water-tight seal when said protective helmet and said hood are joined together; the hood and said transparent face place portion forming a dry enclosure around the entire head of the diver when the diving helmet is in use to keep the head dry.

2. The diving helmet of claim 1 wherein said outer helmet further includes a hat portion which fits over and around the top, sides an back of the diver's head during use; said hat portion and said mask portion of said outer helmet being hingedly connected together to move a total of at least ninety degrees with respect to one another; whereby said outer helmet can easily be removed from around the head of the diver by moving said hat portion about the hinge connection and away from the head.

3. The diver's helmet of claim 1 wherein said mask portion further includes a further secondary seal supplemental to said hood and helmet sealing members, said secondary seal comprising a soft resilient ring gasket placed within said mask portion about and within said helmet sealing member, the face of said ring gasket being in frontal, sealing engagement with the face of the diver when said mask portion and said inner hood are joined together.

4. The diver's helmet of claim 2 wherein said hat portion and said mask portion have an interlocking, controlled latch mechanism including a hat latch portion and a mask latch portion, said mask latch portion including latch engaging means for engaging said hat latch portion for locking said mask and said hat portions together, and said hat latch portion including hand-controlled latch disengaging means for causing said latch engaging means to become disengaged from said hat latch portion, the hand control for said disengaging means being located on said hat portion; whereby the hat portion can be disengaged from said mask portion and moved up from said mask portion about the hinge connection between the two and forward with respect to the diver's head all in one quick, single and continuous motion.

5. The diver's helmet of claim 4 wherein said hand control comprises a rotatable elongated knob which is rotatable about an axis perpendicular to the side of said hat portion and which is biased in a latch engaging position with its axis of elongation at least generally perpendicular to the main axis of the diver's body when said helmet is in protective use.

6. The diver's helmet of claim 2 wherein said hood sealing member includes an encircling wedge-shaped tongue seal and said helmet sealing member including a like, encircling groove into which said wedge shaped tongue seal fits, and wherein said hat portion and said mask portion mate together with said wedge-shaped tongue seal between them when said hat and mask portions are hinged together, said hat portion including a ridge about its frontal edge which engages the rear of said wedge-shaped tongue seal and drives the tip of it into said groove.

7. The diver's helmet of claim 6 wherein said groove is curved in cross-section and the tip of said wedge-shaped tongue seal includes a flexible, curved piece of material which mates up and along the curved surface of said groove in frontal engagement therewith when said hat and said mask portions are hinged together with said tongue seal therebetween.

8. The diver's helmet of claim 2 wherein the interior of said hat portion includes a webbing of adjustable straps for fitting said hat portion to the head of the diver, said webbing supporting said hat portion on the head of the diver during protective use of the helmet.

9. A protective helmet of the type used to isolate the head of the user from the exterior ambient comprising:

flexible inner hood means for covering all of the user's head and neck in relatively close proximity thereto except for the facial portions thereof, said hood means having a facial opening around the area which is placed in proximity to the facial portions of the user and having a hood sealing member around said opening, said hood means having a head portion and a neck opening and including lower sealing means for forming a fluid-tight seal with the body of the user at a point below the user's head;

a separate, rigid, protective outer helmet having a transparent face plate mask portion therein and having a helmet sealing member around said face plate mask portion; said outer helmet and said hood being two structurally separate elements which can be temporarily joined together during use as a protective, environment sealing helmt to form a fluid-tight seal but which can be relatively easily separated for bail-out purposes; said transparent face plate mask portion and said facial opening being aligned together and said helmet sealing member and said hood sealing member being connected together to form a fluid-tight seal when said protective helmet and said hood are joined together; the hood and said transparent face plate portion forming an enclosure free of the exterior ambient around the entire head of the diver when the helmet is in use to keep the head from being in contact with the exterior ambient.

10. The diving helmet of claim 9 wherein said hood means further includes a constricted neck opening means for forming a fluid-tight seal around the neck portion of the user.

11. The protective helmet of claim 9 wherein said outer helmet further includes a hat portion which fits over and around the top, sides and back of the user's head during use; said hat portion and said mask portion of said outer helmet being hingedly connected together to move a total of at least ninety degrees with respect to one another; whereby said outer helmet can easily be removed from around the head of the user by moving said hat portion about the hinge connection and away from the head.

12. The protective helmet of claim 11 wherein said mask portion further includes a further secondary seal supplemental to said hood and helmet sealing members, said secondary seal comprising a soft resilient ring gasket placed within said mask portion about and within said helmet sealing member, the face of said ring gasket being in frontal, sealing engagement with the face of the diver when said mask portion and said inner hood are joined together.

13. The protective helmet of claim 12 wherein the interior of said hat portion includes a webbing of adjustable straps for fitting said hat portion to the head of the user, said webbing supporting said hat portion on the head of the user during protective use of the helmet.

* * * * *